United States Patent [19]

Yamamoto et al.

[11] Patent Number: 4,697,446

[45] Date of Patent: Oct. 6, 1987

[54] ROLL FORMING APPARATUS

[75] Inventors: Yoshun Yamamoto; Hitoshi Okubo, both of Kitakyushu; Yutaka Watanabe, Tokai; Eizo Uchiyama; Yutaka Yasunaga, both of Kitakyushu, all of Japan

[73] Assignee: Nippon Steel Corporation, Tokyo, Japan

[21] Appl. No.: 765,957

[22] Filed: Aug. 15, 1985

[51] Int. Cl.[4] ..... B21D 5/12; B21C 37/08

[52] U.S. Cl. ..... 72/178; 72/181; 72/52

[58] Field of Search ..... 72/176–178, 72/182, 51, 52, 181; 228/17, 17.5, 147, 151; 219/59.1, 61.3, 61.11, 60.2

[56] References Cited

U.S. PATENT DOCUMENTS

| | | | |
|---|---|---|---|
| 1,141,066 | 5/1915 | Lloyd | 72/177 |
| 2,248,088 | 7/1941 | Kane | 72/181 |
| 3,159,199 | 12/1964 | Ruple | 72/178 |
| 3,635,064 | 1/1972 | Chang | 72/178 |
| 4,122,696 | 10/1978 | Midzutani et al. | 72/52 |
| 4,299,108 | 11/1981 | Kato et al. | 72/52 |
| 4,487,046 | 12/1984 | Abbey, III | 72/178 |

FOREIGN PATENT DOCUMENTS

| | | | |
|---|---|---|---|
| 2716940 | 2/1978 | Fed. Rep. of Germany | 72/178 |

*Primary Examiner*—Daniel C. Crane

*Attorney, Agent, or Firm*—Wenderoth, Lind & Ponack

[57] ABSTRACT

A roll forming apparatus has an elevatable base that is moved up and down by an elevating mechanism. Carriages are movably mounted on the base on both sides of a forming pass line. Each carriage carries several side rolls that are disposed along the forming pass line. A pair of side roll position adjusting mechanisms are coupled to each carriage. The pair of side roll position adjusting mechanisms move a carriage back and forth to form the desired forming pass. An elevating mechanism is provided to move up and down the base so that the level and inclination of the forming pass line is set as desired.

17 Claims, 24 Drawing Figures

ROLL FORMING APPARATUS

BACKGROUND OF THE INVENTION

1. Field of the Invention

This invention relates to a roll forming apparatus that gradually bends a metal sheet into the desired shape using forming rolls.

2. Description of the Prior Art

With conventional roll forming apparatuses, such as electric-resistance welded (ERW) tubular product mills, forming is commonly accomplished by use of grooved rolls. In order to form products of different sizes on the same apparatus, therefore, the grooved rolls must be changed every time to those corresponding to the desired product size. For this reason, many sets of rolls corresponding to the number of product sizes to be rolled on the apparatus must be prepared ready for use. The roll changing task is so complex and time-consuming that both equipment utilization rate and productivity drop considerably.

To solve the above problem, a roll forming apparatus proposed by the U.S. Pat. No. 3,472,053 has its side rolls adjusted and put in a position according to the desired size as shown in FIG. 1. This apparatus has several pairs of relatively small-diameter side rolls 9 arranged along and on both sides of the forming line. A carriage 10 carrying each side roll 9 is slidably engaged with an inclined straight passage 12 on the base 11. A screw-down mechanism 13 moves the carriage 10 along the inclined straight passage 12 to put the side roll 9 in a position suited for forming a product of the desired size.

However, the position adjustment of the side roll 9 on this apparatus is limited to the direction along the inclined straight passage 12. Longitudinal pass line height adjustment according to product size, which permits, for example, down-hill roll forming intended for the prevention of edge waviness that might occur particularly in the forming of thin materials, cannot be achieved. Furthermore, the structural design to move the side rolls along the inclined straight passage does not permit providing a high enough rigidity such as might be required in forming products of high-tensile material, i.e. that require great force in being formed due to a heavy wall thickness and small finished size.

In forming ERW pipe of small diameter and heavy wall thickness, particularly in cage forming, the material may develop a kink in the course of forming, thereby causing a reduced operation efficiency or even making it impossible to continue the forming operation.

SUMMARY OF THE INVENTION

An object of this invention, which has solved the above-described problems, is to provide a roll forming apparatus that is capable of easily and rapidly adjusting the height and slope of the forming pass line according to the size of the product to be formed.

Another object of this invention is to provide a roll forming apparatus that has a high enough rigidity to satisfactorily form products of heavy wall thickness and small size that have been difficult to roll with conventional roll forming apparatuses.

Still another object of this invention is to provide a roll forming apparatus that inhibits and corrects the kink of the piece being formed to ensure that the resulting product obtains a good shape.

A roll forming apparatus of this invention has an elevatable base that is moved up and down by an elevating mechanism. Carriages are mounted on the base and lie on both sides of the forming pass line. Each carriage rotatably carries several side rolls that are disposed along the pass line. To the carriage is coupled a side roll position adjusting mechanism.

The roll forming apparatus is also equipped with at least one of a bottom roll, top roll, kink inhibiting and correcting roll, and edge guide roll. These rolls are connected to the roll position adjusting mechanism either directly or indirectly.

With the roll forming apparatus just described, the side roll position adjusing mechanism is operated to move forward or backward the carriages so that the side rolls form the desired forming pass. The elevating mechanism moves the base up or down to set the height and slope of the forming pass line as desired. The bottom, top, kink inhibiting and correcting, and edge guide rolls are likewise adjusted by their individual roll position adjusting mechanisms to form the desired forming pass.

On the apparatus of this invention, the individual roll position adjusting mechanisms and carriage elevating mechanisms are controlled independently. This permits adjusting the position of each forming roll to any cross section of the piece being formed and any pass line level, as a result of which an appropriate pass line level and forming roll setting can be achieved.

Furthermore, the apparatus according to this invention is capable of forming products of a wide range of sizes without changing rolls. The apparatus can also freely adjust the longitudinal level of the forming pass line, thereby permitting a down-hill or other desired mode of forming.

The mechanism to adjust the pass line level is separated from the mechanism to determine the relative position of the side and bottom rolls according to the cross section of the piece being formed. As a consequence, the distance between the top surface of the base and the point where the side roll comes in contact with the piece, which has a bearing on the rigidity of the side roll assembly, can be reduced by the amount by which the pass line level is adjusted. This, in turn, reduces the displacement of the side roll assembly that might occur under the influence of the forming force. Besides, the structural design of the apparatus of this invention offers higher rigidity than the conventional apparatus of the inclined side roll screwdown type as shown in FIG. 1. The forming apparatus possessing such a high rigidity can produce high-quality products ranging widely from small to large in size, from light to heavy in wall thickness, and from low to high in tensile strength.

When the kink inhibiting and correcting rolls are provided, even products of heavy thickness and small size can be formed stably.

DESCRIPTION OF THE PREFERRED EMBODIMENTS

Now this invention will be further described by reference to the ERW pipe mills shown in the accompanying drawings.

Figure 2A:
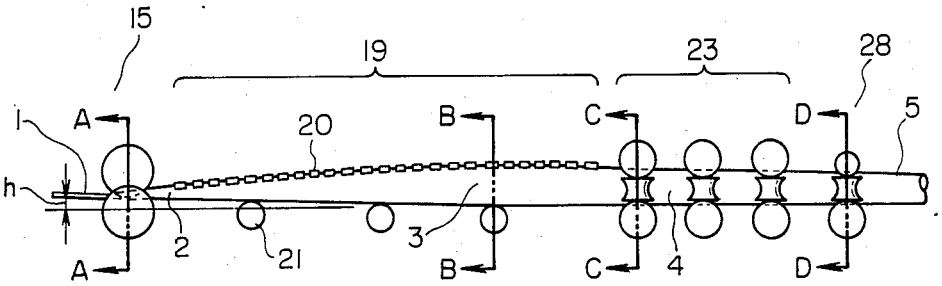
FIGS. 2*a* and 2*b* are a layout of a pipe forming line containing a roll forming apparatus according to this invention.
Figure 2B:
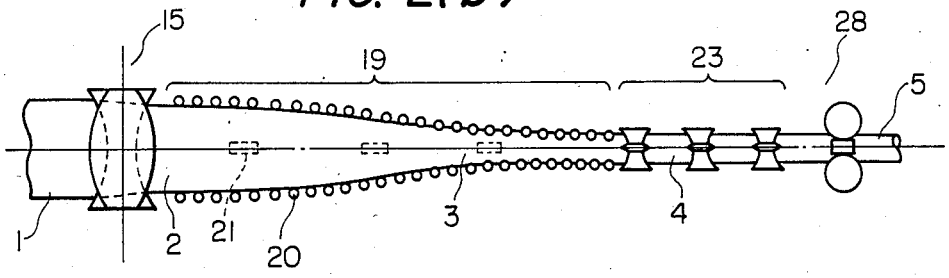

FIG. 2 shows an example of an ERW pipe mill that contains a roll forming apparatus according to this invention as an intermediate forming stand. In FIG. 2, a side view is shown at (*a*) and a plane view at (*b*). At (*a*), (*b*), (*c*) and (*d*) of FIG. 3 are shown cross sections of the piece being formed taken across the lines AA, BB, CC, and DD of FIG. 2.

The ERW pipe mill comprises an initial forming stand 15, an intermediate forming stand 19, a finishing forming stand 23 and a squeezing stand 28 that are disposed along the forming pass line as shown in FIG. 2. The initial forming stand 15 has a pair of forming rolls 16 and 17, one placed over the other, that bend a flat strip 1 into a curved piece 2 as shown at (*a*) of FIG. 3. The intermediate forming stand 19 has, as shown at (*b*) of FIG. 3, side rolls 20 that press the edge portions 6 of the piece 3 being formed toward a round shape and bottom rolls 21 to support the bottom surface of the piece. A more detailed description of the intermediate forming stand 19 will be given later. The finishing forming stand 23 of this preferred embodiment comprises three stands as shown at (*c*) of FIG. 3, each stand having a pair of rolls 24 disposed horizontally, a bottom roll 25 and a finishing roll 26 at the top which, in combination, form the piece into an almost closed circular shape 4. The squeezing stand 28 comprises top rolls 31, a pair of horizontally disposed rolls 29 and a bottom roll 30, which together squeeze the piece into a round pipe 5 as shown at (*d*) of FIG. 3.

Figures 3A, 3B, 3C, 3D:
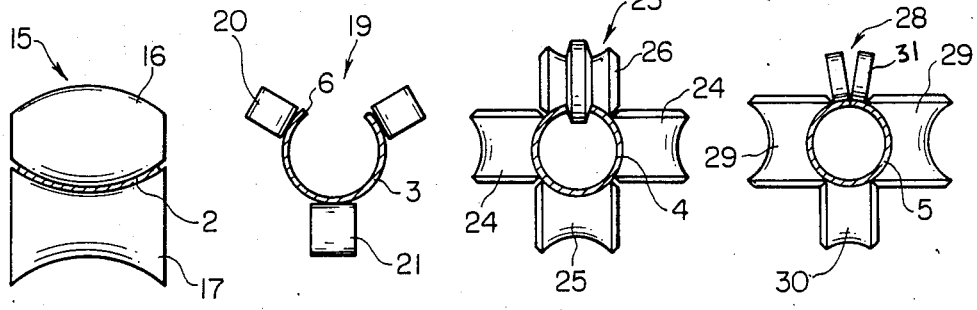
FIGS. 3*a–d* are cross-sectional views of the apparatus shown in FIG. 2, which illustrates how the roll forming is performed.

The flat strip 1 is gradually formed into a round shape while passing through the forming stands 15, 19, 23 and 28, as shown at (*a*), (*b*) and (*c*) of FIG. 3, the resulting almost closed piece getting finished into the round pipe 5 on being welded by a welding machine (not shown). Usually, the welded piece is then finished into a pipe of the desired cross section by a following stretch reducer or sizer (not shown). When continuously formed by the forming rolls as just described, the piece being formed tends to elongate more at the edge portion than in the middle. The elongated edge portion will become bent and longitudinally wavy when subjected to welding. The waviness can be prevented by lowering the bottom line of the piece as the forming action proceeds. Reference character h in FIG. 2(*a*) designates the amount of downhill forming. The undesirable waviness can be prevented by choosing an appropriate distance h for the amount of downhill forming.

Figure 4:
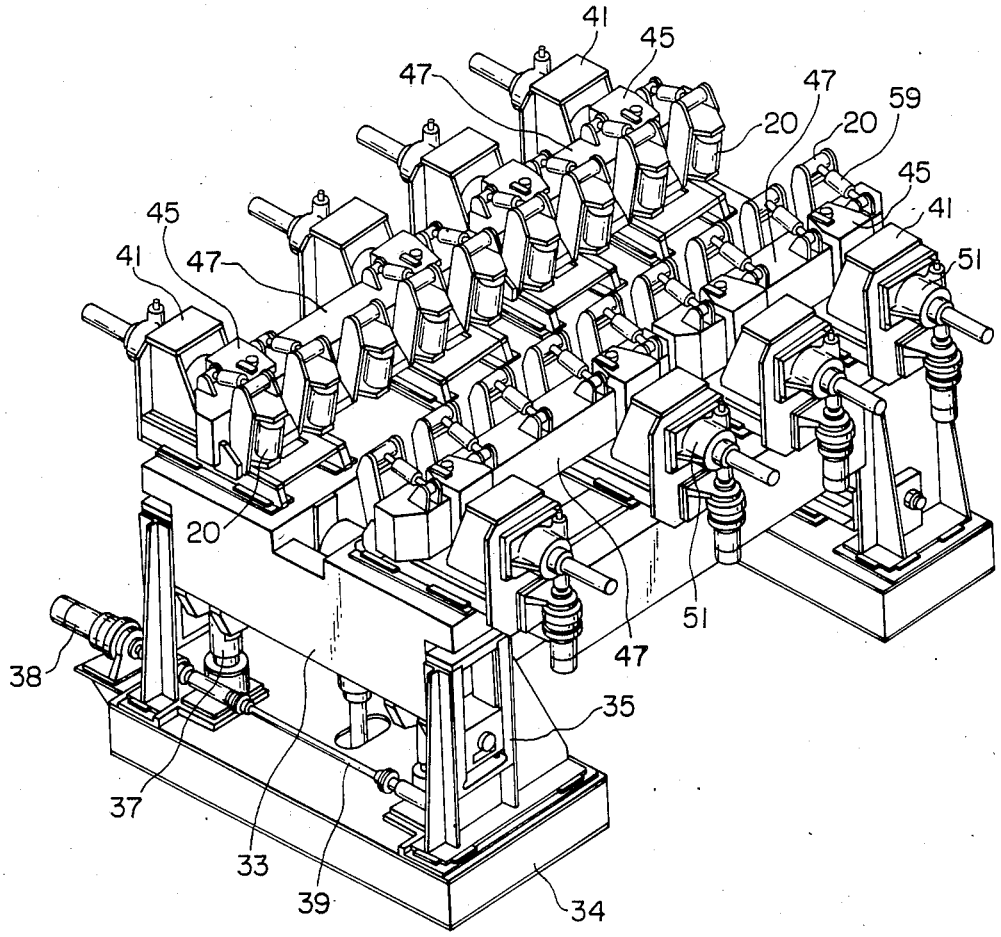
FIG. 4 is a perspective view of a roll forming apparatus which is a preferred embodiment of this invention.
Figure 5:
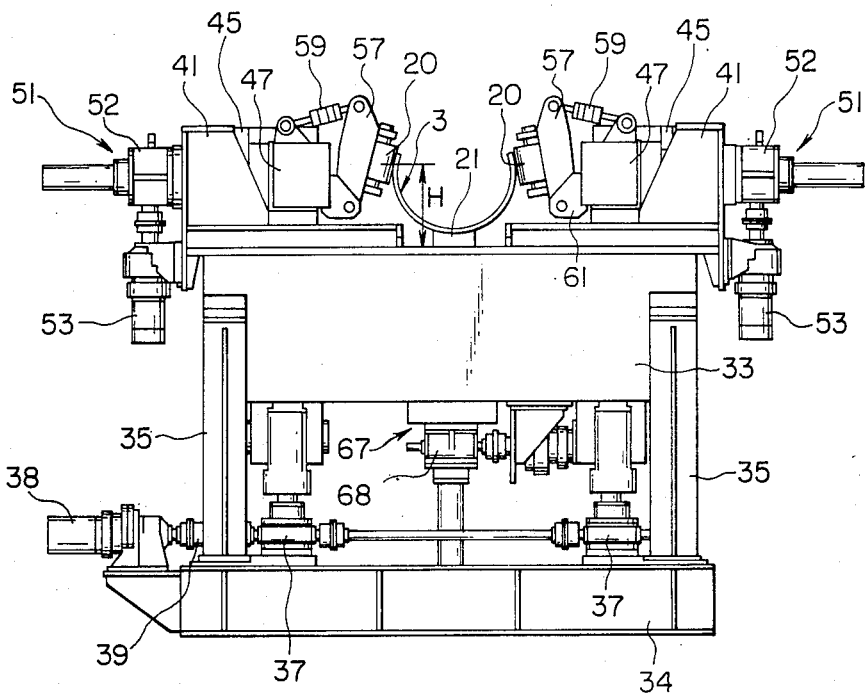
FIG. 5 is a front view of the apparatus shown in FIG. 4.

FIGS. 4 and 5 are a perspective and a top view of the intermediate forming stand mentioned above.

As shown in these figures, a base 33 which extends in a longitudinal direction and lying below the pass line is held above a base frame 34 by a worm jack 37 which is driven by a motor 38 through a transmission 39. The worm jack 37 moves the base 33 up and down along a vertical guide 35 mounted on the base frame 34. At least one worm jack 37 is provided along the pass line to permit the adjustment of the pass line level.

Figure 6:
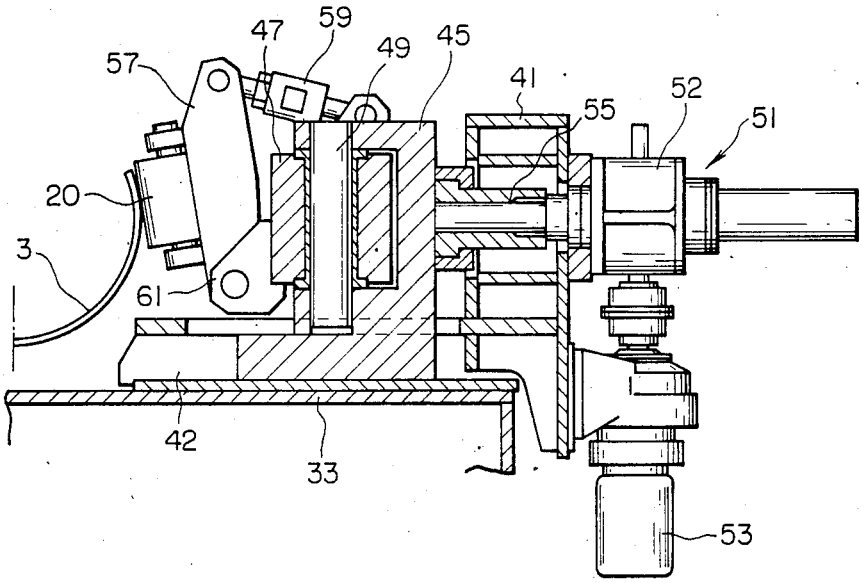
FIG. 6 is a sketch of a side roll position adjusting mechanism of the apparatus shown in FIG. 4.

Support frames 41 are mounted on the base, each pair of frames standing face to face across the forming pass line. Each support frame 41 has a slide passage 42 extending at a right angle to the forming pass line as shown in FIG. 6. The support frames 41 and base 33 may also be put together into one piece.

The support frame 41 carries a sliding block 45 in such a manner as to be reciprocatable along said slide passage 42.

A pair of sliding blocks 45 adjoining in the direction of the forming pass line support a beam-like carriage 47. The carriage 47 is connected to the sliding block 45 by a pivot 49. Two pairs of carriages 47 facing each other across the forming pass line are therefore mounted on the base 33 in such a manner as to be reciprocatable perpendicular to a vertical plane containing the forming pass line. In other words, the carriages 47 are divided into two groups in the direction of the forming pass line. A one-piece carriage may be used instead of the divided ones 47.

A side roll position adjusting mechanism 51 is mounted on the support frame 41. The side roll position adjusting mechanism 51 comprises a worm jack 52 and a motor 53 that drives said worm jack. The worm jack 52 is coupled to the back of the sliding block 45 through a cylindrical shaft 55.

Bearing pedestals 57 are attached to the carriage 47. The upper and lower ends of the bearing pedestal 57 are pin-connected to the front end of a turnbuckle 59 and a bracket 61 mounted on the carriage 47, respectively. The rear end of the turnbuckle is pin-connected to the carriage 47. Accordingly, the angle of inclination of the bearing pedestal 57 with respect to the forming pass line can be adjusted by expanding or contracting the turnbuckle 59.

The side rolls 20 are rotatably attached to the individual bearing pedestals 57 along the forming pass line. The number of side rolls to be carried by each carriage 47 or, in other words, integrally adjusted by the roll position adjusting mechanism is determined according to the type of forming equipment and conditions.

Figure 7:
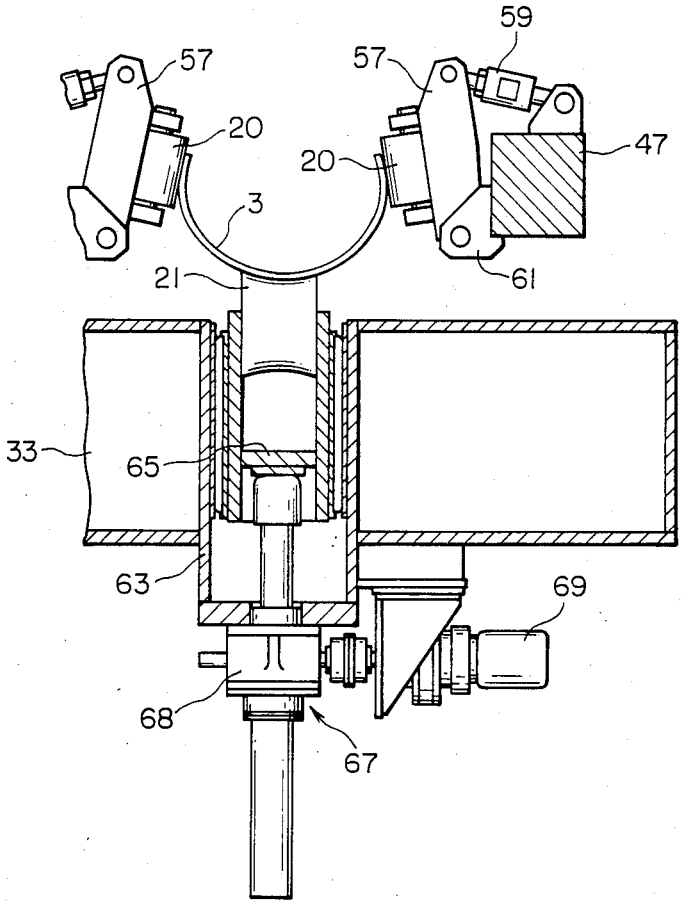
FIG. 7 is a sketch of a bottom roll position adjusting mechanism of the apparatus shown in FIG. 4.

A guide frame 63 is provided in the middle of the width of said base 33 as shown in FIG. 7. A bearing pedestal 65 is elevatably inserted in the guide frame 63. To the bottom end of the guide frame 63 is attached a bottom roll position adjusting mechanism 67. The bottom roll position adjusting mechanism 67 comprises a worm jack 68 and a motor 69 to drive the same worm jack. The worm jack 68 supports the bearing pedestal 65 from below.

The bearing pedestal 65 rotatably supports the bottom roll 21 so that the axis thereof extends horizontally. Positioned directly below the forming pass line, the bottom roll 21 makes up a forming pass in conjunction with the side rolls 20.

One or more intermediate forming stands of this type are provided along the forming pass line. An intermediate forming stand of this type or a simple set of pinch rolls may be used as the initial forming stand.

The side rolls 20 and the bottom roll 21 in the above preferred embodiment are idle but they may be driven, also.

The following paragraphs describe the operation of the intermediate forming stand just described.

Before start-up, the angle of inclination of each side roll 20 is adjusted by expanding or contracting the turnbuckle 59. After start-up, this angle adjustment is normaly dispensed with.

Next, the side roll position adjusting mechanism 51 and bottom roll position adjusting mechanism 67 are driven to adjust the relative position of the side rolls 20 and bottom roll 21 so that the desired draft is obtained. By so doing, a series of passes to form the piece into the desired form is established along the forming pass line. Then, the motor 38 is driven to cause the worm jack 37 to elevate the base 33 so that the pass line is set at the desired level.

After the forming pass has been thus established, the piece is fed from the initial forming stand 15 to the intermediate forming stand 19 as shown in FIG. 2, thereby being gradually formed into a round shape.

The position of the side rolls 20, bottom roll 21 and base 33 may be adjusted in any order or simultaneously.

Figure 1:
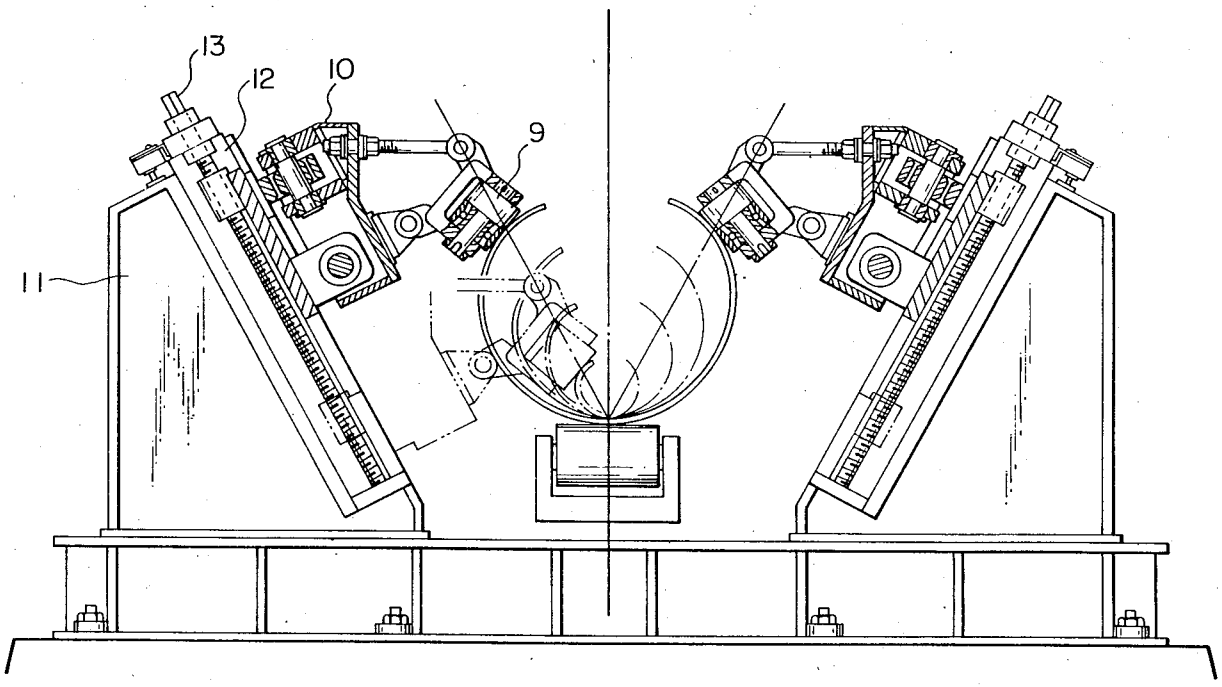
FIG. 1 PRIOR ART
FIG. 1 is a front view of a conventional roll forming apparatus.

As is obvious from the above description, the pass line level adjusting mechanism is separated from the mechanism that determines the relative position of the side rolls 20 and bottom roll 21 according to the cross section of the piece being fromed. As a consequence, the height H shown in FIG. 5 (the distance between the top surface of the base 33 and the point where the side rolls come in contact with the piece), which has a bearing on the rigidity of the side roll assembly, is limited only by the cross section of the largest piece to be formed. As such, the height H can be reduced by the amount equal to that by which the pass line level is adjusted. This, in turn, reduces the displacement of the side roll assembly that might occur under the influence of the forming force. Furthermore, this provides a more rigid structure than the conventional apparatus of the inclined side roll screwdown type as shown in FIG. 1.

This invention is by no means limited to the preferred embodiment just described but is capable of a wide range of variations.

The worm jack 37 to move the base 33 up and down may be attached directly to the foundation, rather than to the base frame 34.

The angle of the side roll 20 may be adjusted by liner adjustment or other means, instead of manipulating the turnbuckle 59 as in the preferred embodiment described before. Also, the bearing pedestal 57 and carriage 47 may be integrated into one piece with a provision to predetermine the setting angle of each roll through initial adjustment.

The carriages 47 which are lolngitudinally bisected in the above-described preferred embodiment may also be divided into any desired number of segments. Instead of attaching several side rolls 20 to a carriage 47, one side roll may be provided for each carriage to permit an independent adjustment of each roll. In this case, the carriage 47 and sliding block 45 are integrated into a one-piece assembly.

The position adjustment of the side rolls 20 and bottom roll 21 may be achieved by means of hydraulic cylinders instead of worm jacks.

Figures 8A, 8B, 8C, 8D:
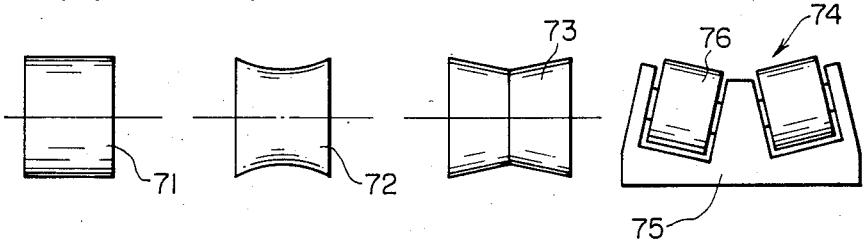
FIGS. 8*a–d* are diagram illustrating the types and shapes of forming rolls.

The side rolls 20 and bottom roll 21 are not limited to the cylindrical and concave rolls used in the preferred embodiment described before. For example, a cylindrical roll 71, concave roll 72, V-surfaced roll 73, a combination roll 74 comprising two cylindrical rolls 76 held by a bearing pedestal 75, as shown at (*a*), (*b*), (*c*) and (*d*) of FIG. 8, and rolls of any other suitable shape and combination may be used. The considerations involved in the choice of the rolls include the avoidance of damage to the product surface, cost and installation space. These rolls may also be used as the bottom roll.

In the description of some other preferred embodiment that will follow, members similar to those in the above-described preferred embodiment will be denoted by the same reference characters, without giving any detailed description.

Figure 9:
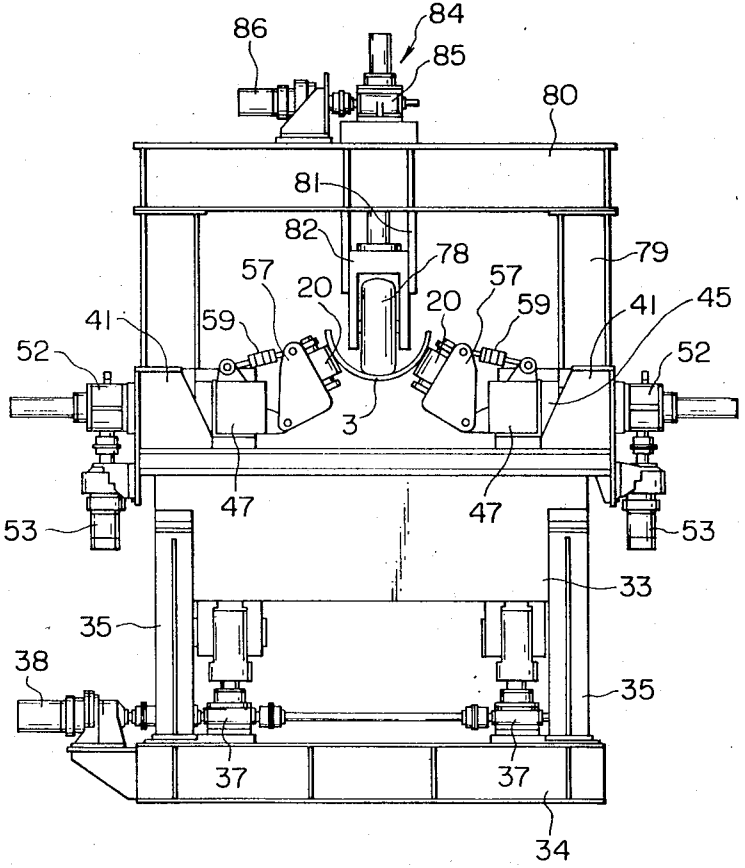
FIG. 9 is a front view of a roll forming apparatus which is a second preferred embodiment of this invention.

FIG. 9 shows another preferred embodiment of this invention in which the forming rolls are made up of side rolls 20 and a top roll 78 instead of the side rolls 20 and the bottom roll 21 used in the above-described preferred embodiment.

As shown in FIG. 9, a crossbeam 80 extends from a support 79 over the base 33 in such a manner as to extend across the forming pass line. A guide frame 81 is provided in the middle of the length of the crossbeam 80. An elevatable bearing pedestal 82 is inserted in the guide frame 81. A top roll position adjusting mechanism 84 comprising a worm jack 85 and a motor 86 is attached to the top end of the guide frame 81. To the bottom end of the worm jack 85 is coupled a bearing pedestal 82. The bearing pedestal 82 rotatably supports the top roll 78 so that the axis thereof extends horizontally. The top roll 78 placed over the forming pass line forms a forming pass together with the side rolls.

While the bottom roll 21 is subjected to the depressing force exerted by the side rolls 20, the top roll 78 receives the pushing up force of the side rolls 20 in the preceding forming stage.

Figure 10:
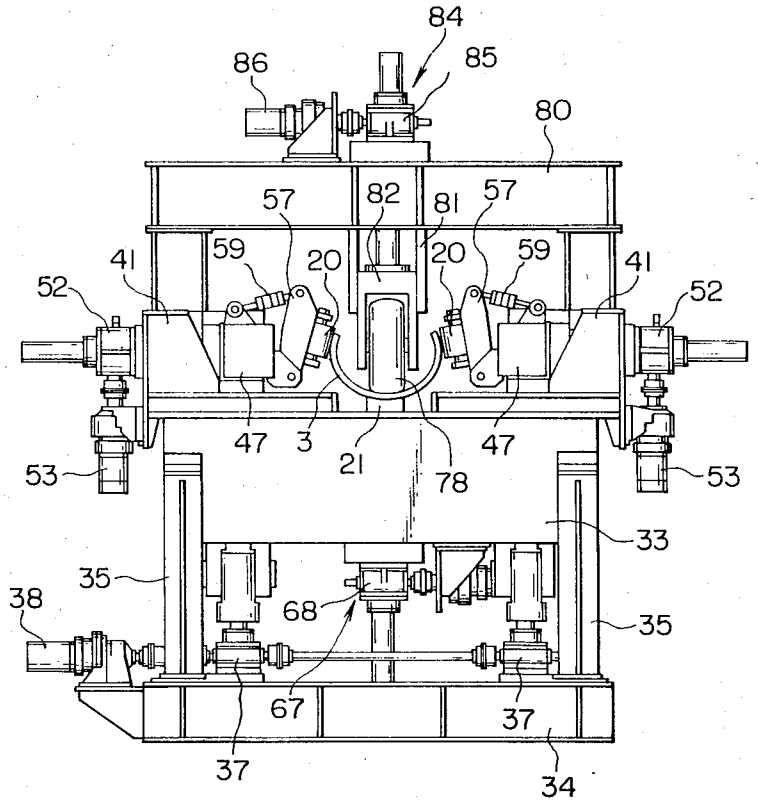
FIG. 10 is a front view of a roll forming apparatus which is a third preferred embodiment of this invention.

FIG. 10 shows still another preferred embodiment of this invention, in which a forming pass is made up of a combination of the side rolls 20, bottom roll 21 and top roll 78. The position adjustment of the side rolls 20, bottom roll 21 and top roll 78 is achieved by a worm jack 52, 68 and 85, respectively. Since the piece is held by the bottom roll 21 and top roll 78, the forming pass line remains stable enough to assure good forming.

Figure 11A:
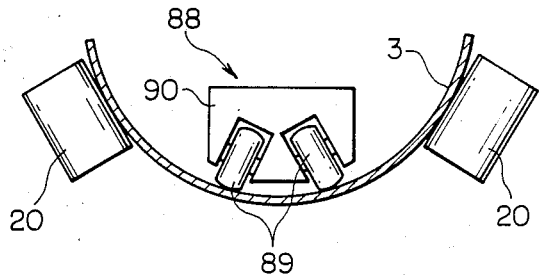
FIGS. 11*a* and 11*b* are front views showing the top roll in other preferred embodiments.
Figure 11B:
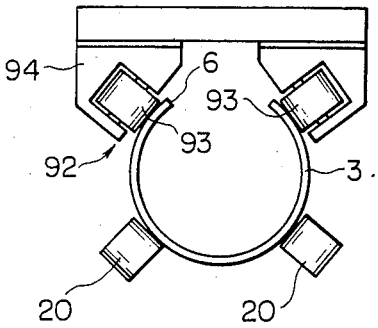

The single top roll 78 used to press the inside of the curved piece in FIGS. 9 and 10 may be replaced with two or more rolls. At (*a*) of FIG. 11 is shown an embodiment in which a top roll 88 consists of paired inside pressing rolls 89 rotatably held by a bearing pedestal 90. The bearing pedestal is connected to the worm jack attached to said crossbeam. The paired inside pressing rolls 89 press the inside of the partially formed piece 3. A preferred embodiment shown at (*b*) of FIG. 11 has a top roll 92 consisting of paired cylindrical rolls 93 rotatably held by a bearing pedestal 94. The paired cylindrical rolls 93 are adapted to press the edge portions 6 of the outside of the partially formed piece 3. While the preferred embodiment shown at (*a*) of FIG. 11 is usually suited for the initial stage of forming, the one shown at (*b*) of FIG. 11 is for the later stage.

While the side, top and bottom rolls in the above preferred embodiments are all idle, the top and/or bottom rolls or the side rolls may be driven as required.

Figure 12:
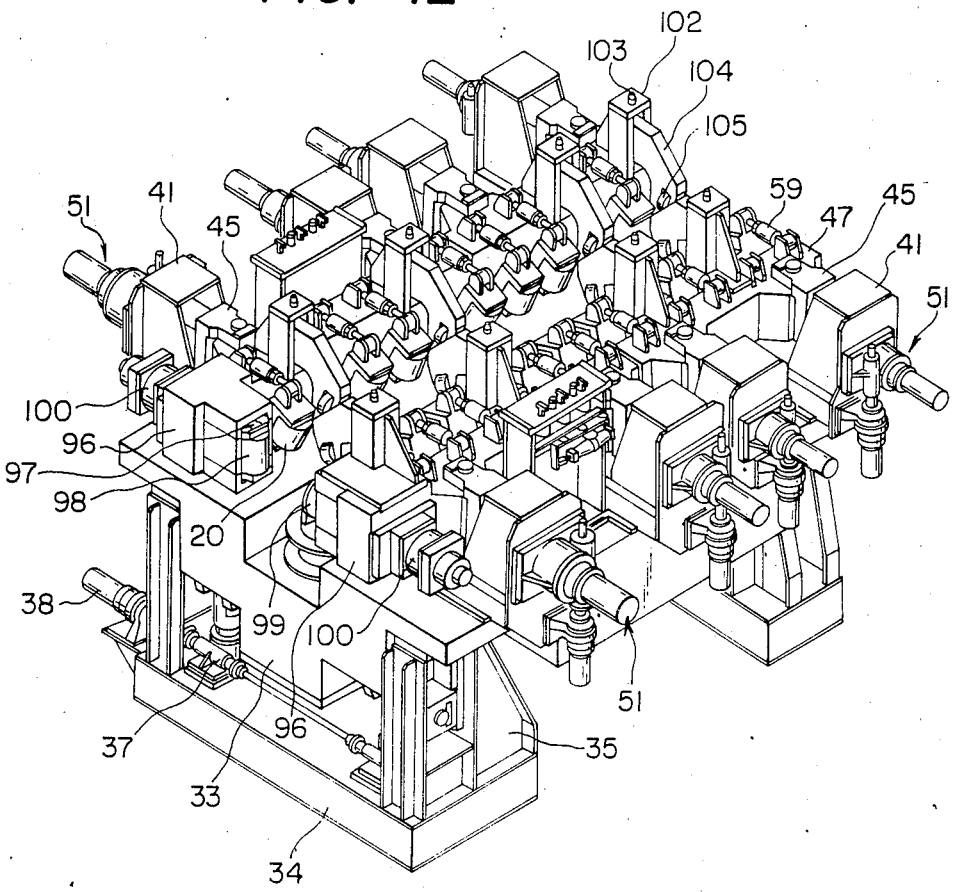
FIG. 12 is a perspective view of a forming stand equipped with kink inhibiting and correcting rolls and edge guide rolls.

FIG. 12 shows an example of an intermediate forming stand that inhibits and corrects a kink or twist that might occur in the forming process.

The structure of the intermediate forming stand shown in FIG. 12 is substantially the same as that of the stand shown in FIG. 4. At the entry end of the intermediate forming stand, there is provided a pair of housings 96 standing face to face across the forming pass line, with each housing attached to the carriage 47. The housing 96 rotatably supports kink or twist inhibiting and correcting rolls 98 and 99 through a bearing 97. To the housing 96 is connected a roll position adjusting mechanism 100 comprising a hydraulic cylinder, which is also connected to a respective roll 98 or 99. The worm jack mentioned previously may be used instead of the hydraulic cylinder constituting the roll position adjusting mechanism 100. Two carrying stands 102 are provided for each carriage 47. An arm 104 is elevatably fitted to the carrying stand 102 using an adjusting screw 103. The arm 104 rotatably holds an edge guide roll 105 at the front end thereof. The edge guide roll 105 normally leaves a clearance between the edge 6 of the piece and the edge guide roll 105 to allow some kink or twist of the piece, facilitate the passage of the front end thereof, and absorb any variation in each piece and among different pieces.

Figure 13:
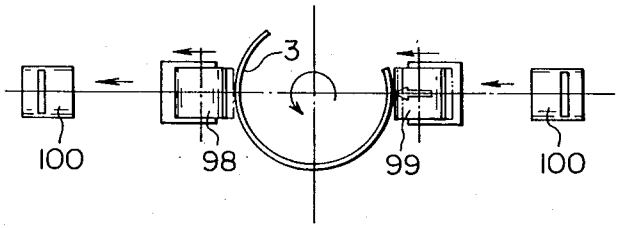
FIG. 13 illustrates an edge guide roll.

If the piece being formed forms any kink or twist as a result of variations in each piece and among different pieces and in forming conditions such as errors in roll setting, the roll position adjusting mechanism 100 adjusts the position of the kink inhibiting and correcting rolls 98 and 99 according to the kink formed. FIG. 13 shows the operation of the kink inhibiting and correcting rolls 98 and 99. When the piece 3 kinks or twists clockwise as illustrated, the kink inhibiting and correcting roll 98 on the left is withdrawn only along a linear path away from the forming pass line while the roll 99 on the right is advanced only along a linear path towards the forming pass line. As a consequence, an anticlockwise dekinking moment works on the piece 3 to correct the formed kink. The edge guide roll 105 facilitates the travel of the piece 3, thereby inhibiting the progress of kink. The inhibition and correction of a kink can be achieved by moving back and forth either one of the kink inhibiting and correcting rolls 98 and 99. However, better results are obtainable when both rolls are moved as described above.

In the preferred embodiment just described, the kink inhibiting and correcting rolls 98 and 99 are provided on the carriage 47 through the housing. Instead, the rolls 98 and 99 may be attached to, for example, the base 33, independent of the carriage 47, in appropriate numbers and places. The roll position adjusting mechanism 100 need not be hydraulic but may be of the screwed or other suitable type. Part of the side rolls 20 may be used also for the inhibition and correction of a kink. Also, the kink inhibiting and correcting rolls 98 and 99 may be provided in several pairs and at suitable intervals.

In the preferred embodiment just described, the side roll position adjusting mechanism 51 moves the edge guide roll 105 and side rolls 20 integrally. Therefore, the position of the individual rolls and the forming line is set according to the cross section of the piece by the side roll position adjusting mechanism 51, bottom roll position adjusting mechanism 67 and/or top roll position adjusting mechanism 84 and the worm jack 37 to move the base 33 up and down. Also, the edge guide roll is properly positioned with respect to the edge 6 of the piece 3 without manipulating the adjusting screw 103.

Figure 15:
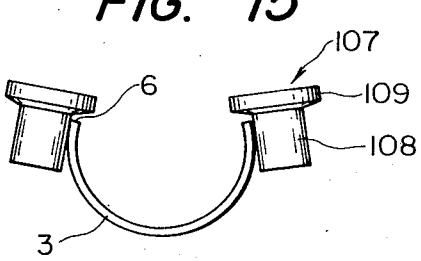
FIG. 15 illustrates a flanged side roll.

FIG. 15 shows another preferred embodiment of the side roll. As shown, a side roll 107 has a flange 109 at the top of the cylindrical, tapered or curved body portion 108 thereof. The flange 109 guides the edge 6 of the piece 3. This structure is characterized by simplicity, though there is a likelihood of the edge portion of the piece 3 getting damaged as a result of a difference in peripheral speed that might occur depending upon the position where the edge portion comes in contact with the body portion 108 or flange 109. The flanged roll 107 may be used for part or all of the side rolls on the intermediate forming stand.

Figure 16:
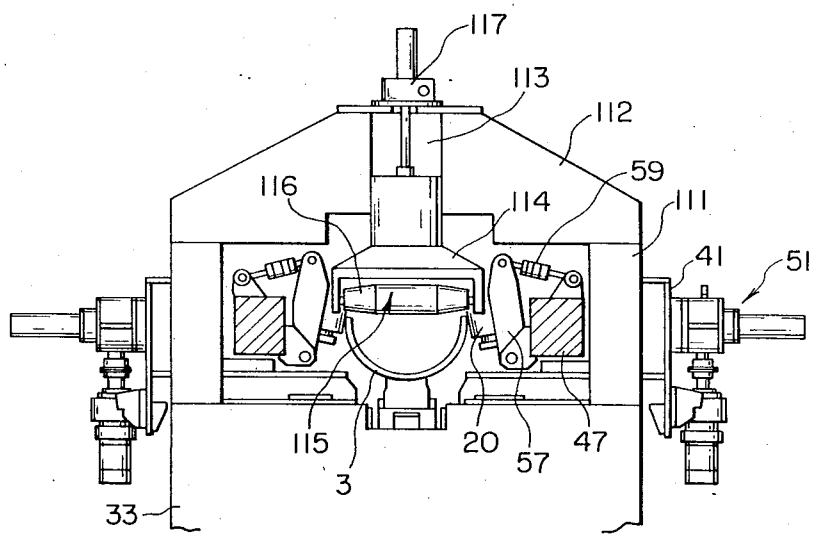
FIG. 16 is a front view showing another preferred embodiment of a roll forming apparatus equipped with edge guide rolls.
Figure 14:
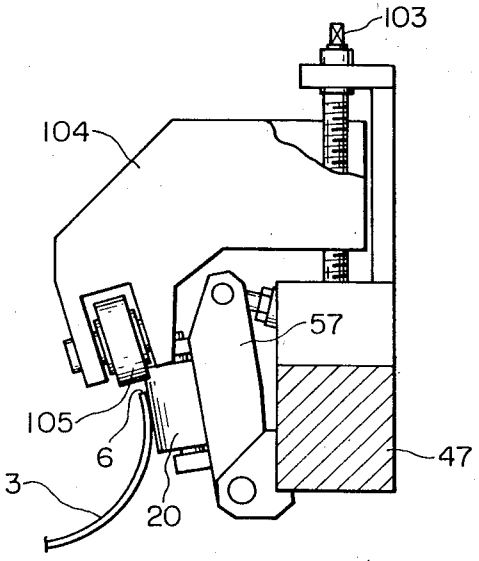
FIG. 14 illustrates the operation of a kink inhibiting and correcting roll.

FIG. 16 shows another preferred embodiment of the edge guide roll. A support 111 carries a crosshead 112 above the base 33. A bearing pedestal 114 is slidably fitted in a guide passage 113 provided in the middle of the crosshead 112. An edge guide roll 115 is rotatably and horizontally supported at the lower end of the bearing pedestal 114. A tapered portion 116 at each end of the edge guide roll 115 guides the edge of the piece being formed. An edge guide roll position adjusting mechanism 117 is connected to the upper end of the bearing pedestal 114. More accurate forming than ever is possible because the position of the edge guide roll is adjusted independently by the roll position adjusting mechanism 117. With an apparatus forming small-diameter pipes and other similar products, the above structure permits a considerable reduction in installation space.

The edge guide is not limited to a guide roll. A slide guide may also serve the purpose but the roll type is preferable when the possible damage to the edge of the piece is considerable.

It should be noted that this invention is by no means limited to the preferred embodiments described herein. By using the apparatuses according to this invention, not only round pipes but also square pipes, channels and other shapes can be formed. The junction of products can be formed not only by electric resistance welding but also submerged arc welding, butt welding and other methods. The number of forming stands, rolls, carrying frames, bearing pedestals and the like are not limited to those employed in the illustrated preferred embodiments, as well.

What is claimed is:

1. A roll forming apparatus for gradually bending a metal sheet into a desired shape using forming rolls disposed along and on both sides of a forming pass line which comprises:

an elevatable base which extends in a longitudinal direction and through which a vertical plane passes which is parallel to said longitudinal direction and contains a forming pass line about which the metal sheet is formed;

means for moving said base up or down in a vertical direction to thereby adjust the height and/or slope of said forming pass line;

at least one pair of carriages, each one of said pair of carriages being movably mounted on said base on opposite sides of said vertical plane so that the carriages move integrally with the base in the vertical direction, said pair of carriage being movable horizontally in a direction perpendicular to said vertical plane;

at least three side rolls rotatably mounted on each of said at least one pair of carriages, each of said side rolls having a roll surface for defining a forming pass;

two side roll position adjusting mechanisms spaced apart in said longitudinal direction and connected between each of said carriages and said base, each of said side roll position adjusting mechanisms being individually adjustable for moving a respective carriage horizontally and orienting said side rolls into a desired position with respect to said vertical plane whereby the metal sheet can be formed into the desired shape; and means for reducing the distance between a top surface of said base and a point of contact between each of said side rolls and the metal sheet formed by said side rolls, said means comprising at least one bearing pedestal movably mounted below the top surface of said base, a bottom roll rotatably supported on said bearing pedestal, said bottom roll having an upper roll surface for defining the forming pass together with said side rolls and a bottom roll position adjusting mechanism connected between said base and said bearing pedestal for moving said bearing pedestal vertically with respect to said base whereby displacement of said side rolls during forming of the metal sheet is reduced and overall rigidity of said roll forming apparatus is improved.

2. The roll forming apparatus of claim 1, further comprising:

at least one bearing pedestal movably mounted on said base;

a top roll rotatably supported by said bearing pedestal, said top roll having a lower roll surface for defining a forming pass together with said side rolls, and a top roll position adjusting mechanism connected between said base and said bearing pedestal for moving said bearing pedestal vertically with respect to said base.

3. The roll forming apparatus of claim 1, further comprising:

a housing spaced longitudinally from said at least three side rolls and mounted on at least one of said carriages;

at least one roll rotatably mounted on said housing for removing and preventing twist of the metal sheet to be formed; and a roll position adjusting mechanism connected between said housing and said at least one roll for moving said roll horizontally with respect to said at least one of said carriages, said at least one roll being movable only along a linear path towards and away from said forming pass line.

4. The roll forming apparatus of claim 1, further comprising means for guiding at least one edge of the metal sheet to be formed, said edge guiding means including at least one stand provided on at least one of said carriages, at least one edge guide roll which is rotatably supported on the stand, and means for adjusting the position of the edge guide roll relative to the side rolls, said position-adjusting means being provided on the stand.

5. The roll forming apparatus of claim 1, further comprising edge guiding means which includes a bearing pedestal movably mounted on said base, at least one edge guide roll rotatably mounted on said bearing pedestal and an edge guide roll position adjusting mechanism connected between said bearing pedestal and said base for moving said bearing pedestal vertically with respect to said base.

6. The roll forming apparatus of claim 1, wherein at least one of said side rolls includes a flange extending radially outward from the surface thereof for guiding an edge of the metal sheet to be formed.

7. The roll forming apparatus of claim 1, wherein each of said carriages is pivotally attached to a pair of sliding blocks, each of said sliding blocks being spaced apart in said longitudinal direction and connected to a respective one of said two side roll position adjusting mechanisms and said side rolls are rotatably supported on respective bearing pedestals which are spaced apart in said longitudinal direction and are pivotably connected about a horizontal axis to each of said carriages whereby said side rolls are each pivotable to a desired horizontal and vertical inclination for forming the metal sheet into the desired shape.

8. The roll forming apparatus of claim 1, wherein said side rolls are mounted for rotation on respective bearing pedestals spaced apart in said longitudinal direction, each of said bearing pedestals being pivotally mounted on a respective carriage for adjusting the position of a respective side roll mounted thereon.

9. The roll forming apparatus of claim 1, wherein said at least one pair of carriages comprises at least two pairs of carriages, said pairs of carriages being arranged end-to-end along said longitudinal direction.

10. A roll forming apparatus for gradually bending a metal sheet into a desired shape using forming rolls disposed along and on both sides of a forming pass line which comprises:

an elevatable base which extends in a longitudinal direction and through which a vertical plane passes which is parallel to said longitudinal direction and contains a forming pass line about which the metal sheet is formed;

means for moving said base up or down in a vertical direction;

at least one pair of carriages, each one of said pair of carriages movably mounted on said base on opposite sides of said vertical plane, said pair of carriages being movable horizontally in a direction perpendicular to said vertical plane;

at least three side rolls rotatably mounted on each of said at least one pair of carriages, each of said side rolls having a roll surface for defining a forming pass;

two side roll position adjusting mechanisms spaced apart in said longitudinal direction and connected between each of said carriages and said base, each of said side roll position adjusting mechanisms being individually adjustable for moving a respective carriage horizontally and orienting said side rolls into a desired position with respect to said vertical plane whereby the metal sheet can be formed into the desired shape;

a housing spaced longitudinally from said at least three side rolls and mounted on at least one of said carriages;

at least one roll rotatably mounted on said housing for removing and preventing twist of the metal sheet to be formed; and a roll position adjusting mechanism connected between said housing and said at least one roll for moving said roll horizontally with respect to said at least one of said carriages, said at least one roll being movable only along a linear path towards and away from said forming pass line.

11. The roll forming apparatus of claim 10, further comprising:

at least one bearing pedestal movably mounted on said base;

a bottom roll rotatably supported on said bearing pedestal, said bottom roll having an upper roll surface for defining the forming pass together with said side rolls; and a bottom roll position adjusting mechanism connected between said base and said bearing pedestal for moving said bearing pedestal vertically with respect to said base.

12. The roll forming apparatus of claim 10, further comprising:

at least one bearing pedestal movably mounted on said base;

a top roll rotatably supported by said bearing pedestal, said top roll having a lower roll surface for defining the forming pass together with said side rolls, and a top roll position adjusting mechanism connected between said base and said bearing pedestal for moving said bearing pedestal vertically with respect to said base.

13. The roll forming apparatus of claim 10, further comprising means for guiding at least one edge of the metal sheet to be formed, said edge guiding means including at least one stand provided on at least one of said carriages, at least one edge guide roll which is rotatably supported on the stand, and means for adjusting the position of the edge guide roll relative to the side rolls, said position-adjusting means being provided on the stand.

14. The roll forming apparatus of claim 10, wherein at least one of said side rolls includes a flange extending radially outward from the surface thereof for guiding an edge of the metal sheet to be formed.

15. The roll forming apparatus of claim 10, wherein each of said carriages is pivotally attached to a pair of sliding blocks, each of said sliding blocks being spaced apart in said longitudinal direction and connected to a respective one of said two side roll position adjusting mechanisms and said side rolls are rotatably supported on respective bearing pedestals which are spaced apart in said longitudinal direction and are pivotably connected about a horizontal axis to each of said carriages whereby said side rolls are each pivotable to a desired horizontal and vertical inclination for forming the metal sheet into the desired shape.

16. The roll forming apparatus of claim 10, wherein said side rolls are mounted for rotation on respective bearing pedestals spaced apart in said longitudinal direction, each of said bearing pedestals being pivotally mounted on a respective carriage for adjusting the position of a respective side roll mounted thereon.

17. The roll forming apparatus of claim 10, further comprising edge guiding means which includes a bearing pedestal movably mounted on said base, at least one edge guide roll rotatably mounted on said bearing pedestal and an edge guide roll position adjusting mechanism connected between said bearing pedestal and said base for moving said bearing pedestal vertically with respect to said base.

* * * * *